US008800186B2

(12) United States Patent
Zhang

(10) Patent No.: US 8,800,186 B2
(45) Date of Patent: Aug. 12, 2014

(54) SHAKING INFLATABLE FIGURE

(71) Applicant: Gemmy Industries Corporation, Coppell, TX (US)

(72) Inventor: Cheng-Chun Zhang, Kaohsiung (TW)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 13/673,387

(22) Filed: Nov. 9, 2012

(65) Prior Publication Data

US 2014/0130385 A1 May 15, 2014

(51) Int. Cl.
*G09F 15/00* (2006.01)
*G09F 19/02* (2006.01)

(52) U.S. Cl.
CPC ..... *G09F 19/02* (2013.01)
USPC ..... 40/610

(58) Field of Classification Search
USPC ..... 40/610; 446/176, 180, 220, 224, 226; 472/134; 52/2.11
See application file for complete search history.

(56) References Cited

U.S. PATENT DOCUMENTS

| | | | | |
|---|---|---|---|---|
| 4,291,704 | A * | 9/1981 | Petty et al. | 600/541 |
| 5,186,675 | A * | 2/1993 | Stoddard | 446/199 |
| 6,186,857 | B1 * | 2/2001 | Gazit et al. | 446/226 |
| 6,439,950 | B1 * | 8/2002 | Goldman et al. | 446/220 |
| 6,804,905 | B1 * | 10/2004 | Burger et al. | 40/610 |
| 7,356,951 | B2 * | 4/2008 | Spielberger et al. | 40/412 |
| 7,614,171 | B2 * | 11/2009 | Hsu | 40/412 |
| 2001/0002354 | A1 * | 5/2001 | Gazit et al. | 446/268 |
| 2003/0013375 | A1 * | 1/2003 | Austin | 446/224 |
| 2006/0025037 | A1 * | 2/2006 | Lau | 446/226 |
| 2006/0037225 | A1 * | 2/2006 | Wei | 40/610 |

* cited by examiner

*Primary Examiner* — Charles A Fox
*Assistant Examiner* — Shin Kim
(74) *Attorney, Agent, or Firm* — Birch, Stewart, Kolasch & Birch, LLP

(57) ABSTRACT

A shaking inflatable figure has a body, an inflating unit and a vibrating unit. The body has an inflatable air chamber. The inflating unit and the vibrating unit are mounted inside the body. The inflating unit pumps air into the air chamber. The vibrating unit has a driving motor. A weight is connected to a spindle of the driving motor at an eccentric direction to the spindle of the driving motor. The vibrating unit is mounted on a partition diaphragm inside the body. Vibrations arising from the shift of center of gravity of the eccentric weight are transmitted to the body through the partition diaphragm so that the body is also vibrated to increase animated visual effect and entertaining pleasure to viewers.

15 Claims, 9 Drawing Sheets

SHAKING INFLATABLE FIGURE

BACKGROUND OF THE INVENTION

1. Field of the Invention

The present invention relates to a displayable figure and more particularly to a shaking inflatable figure.

2. Description of the Related Art

Inflatable figures are entertaining and displayable, are hollow and have air chambers therein. While being inflated, inflatable figures are expanded in volume into a fixed form for the purposes of entertainment, advertisement and decoration. After being deflated, inflatable figures can be folded flat and stored in a compact bag for easy storage. In view of the foregoing advantages and operational flexibility, inflatable figures may be proclaimed as one type of most popular inflatable toys. However, conventional inflatable figures can be only statically exhibited and easily become stereotypical in terms of visual reception. Therefore, toy industry is constantly conceiving how to improve the design of inflatable figures by providing satisfactory entertaining and animated effect through added motion of the inflatable figures.

SUMMARY OF THE INVENTION

An objective of the present invention is to provide a shaking inflatable figure exhibiting a more animated visual effect arising from vibration of the figure.

To achieve the foregoing objective, the shaking inflatable figure has a body, an inflating unit and a vibrating unit.

The body defines an air chamber in the body.

The inflating unit is mounted inside the body and communicates with the air chamber.

The vibrating unit is mounted inside the body.

Preferably, the body has a partition diaphragm, an edge of the horizontal partition diaphragm is connected with an inner wall of the body, and the vibrating unit is mounted on the partition diaphragm.

Preferably, the vibrating unit has a housing, a driving motor and an eccentric vibrator. The housing is mounted on the partition diaphragm. The driving motor is mounted inside the housing. The eccentric vibrator is mounted inside the housing and is connected with the driving motor.

Preferably, the housing of the vibrating unit has an upper case and a lower case combined with each other and further has a waterproof seal ring mounted between the upper case and the lower case.

Preferably, the upper case has an annular groove formed in the upper case for the waterproof seal ring to be mounted in the annular groove, the lower case has a lower engagement wall formed on the lower case and engaging the annular groove of the upper case, and the lower engagement wall has two rising edges formed on the lower engagement wall, spaced apart from each other, and abutting against the waterproof seal ring.

Preferably, the upper case further has an upper engagement wall, multiple upper pillars and a top cover. The upper engagement wall is formed on and protrudes from a top of the upper case and has a gap formed through the upper engagement wall. The upper pillars are formed on the top of the upper case and spaced apart from one another. Each upper pillar has an assembly hole formed in a top of the upper pillar. The top cover is detachably mounted on the upper engagement wall of the upper case, is disc-shaped, and has multiple assembly slots and an engagement groove. The assembly slots are formed in a bottom of the top cover, and are spaced apart from one another. Each assembly slot has a through hole. The engagement groove is formed on the bottom of the top cover. The upper engagement wall of the upper case is located under the partition diaphragm of the body. The top cover is located above the partition diaphragm. The engagement groove engages the upper engagement wall. The upper pillars are respectively sleeved in the assembly slots. Multiple fasteners are used to respectively penetrate through the assembly slots and the assembly holes of the upper pillars to fasten the top cover on the upper case.

Preferably, the upper case further has a wiring box, and the wiring box has a wire holder and a lid. The wire holder is filled with waterproof adhesive. The lid is combined with the wire holder.

Preferably, the driving motor is mounted inside the upper case, and has a spindle and a driving gear. The driving gear is mounted around the spindle. The eccentric vibrator has a transmission gear set and a rocker arm.

The transmission gear set has multiple gears engaging each other and mounted inside a gearbox. The gearbox is mounted on a fixing plate mounted inside the housing. One gear of the transmission gear set engages the driving gear of the driving motor.

The rocker arm is pivotally mounted on the fixing plate and has a passive gear mounted on one end of the rocker arm and engaging another gear of the transmission gear set.

The weight is formed on the other end of the rocker arm.

Preferably, the shaking inflatable figure further has a lighting unit. The body is made of a soft, thin and transparent material.

Given the foregoing technical measures, the shaking inflatable figure can be inflated by the air pump to exhibit an expanded appearance. The driving motor of the vibrating unit drives the rocker arm and the weight to rotate so that the center of gravity of the figure is continuously shifted by the movement of the weight, the vibrating unit generates vibrations with a specific frequency, and the vibrations are transmitted to the body through the partition diaphragm. Accordingly, the body of the figure exhibits an animated visual effect of constant vibrations and increases viewers' entertaining pleasure. The lighting elements of the lighting module can emit light through the transparent wall of the body to render an illuminating figure more visual effect.

The vibrating unit inside the figure has a waterproof design so as to achieve an outdoor waterproof requirement and a broad application range when the figure is used outdoors.

Other objectives, advantages and novel features of the invention will become more apparent from the following detailed description when taken in conjunction with the accompanying drawings.

DETAILED DESCRIPTION OF THE INVENTION

Figure 1:
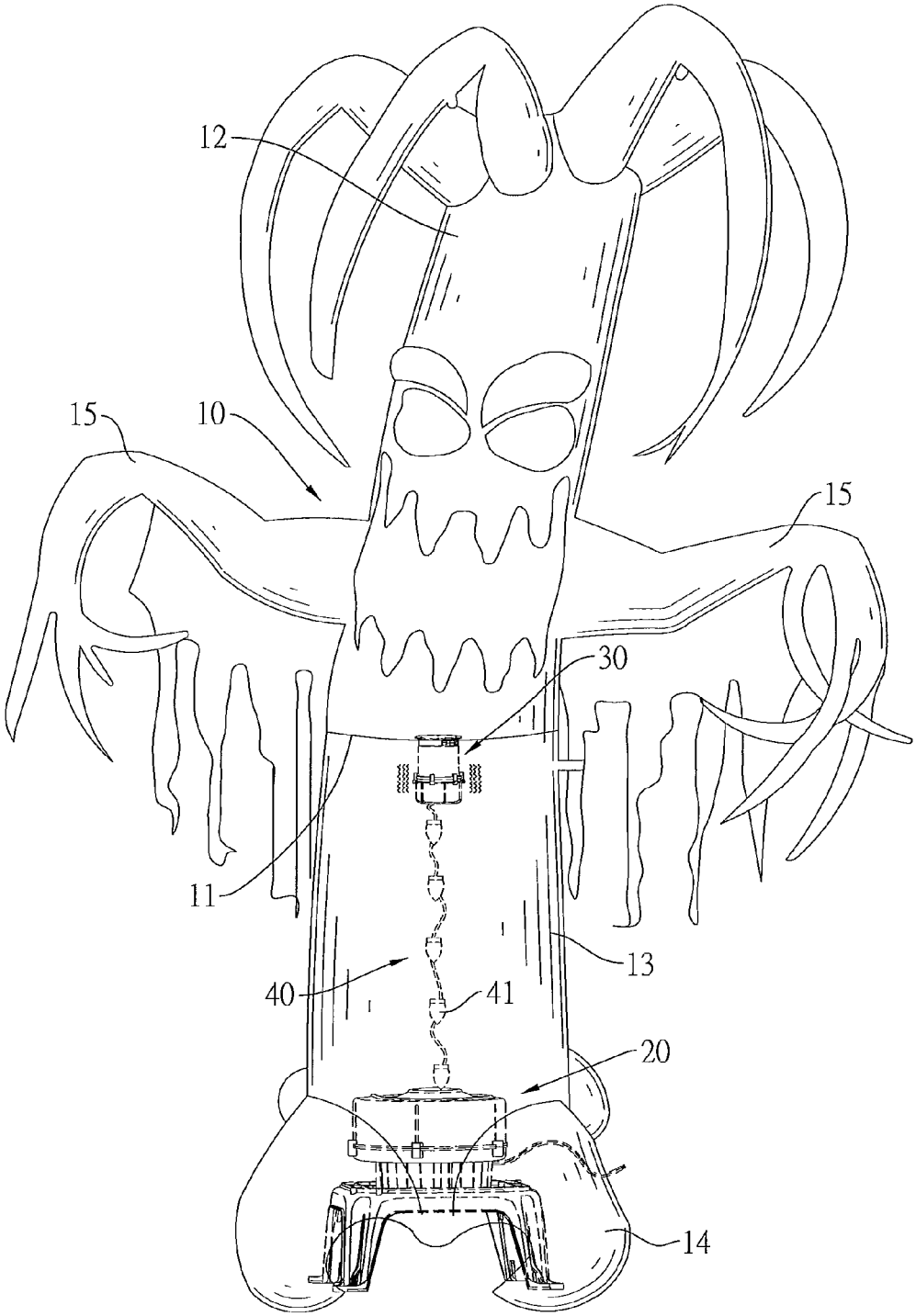
FIG. 1 is a perspective view of a shaking inflatable figure in accordance with the present invention.

With reference to FIG. 1, a shaking inflatable figure in accordance with the present invention has a body 10, an inflating unit 20, a vibrating unit 30 and a lighting unit 40.

The body 10 is hollow and is made of a soft and thin material, has multiple air chambers therein and a partition diaphragm 11. An edge of the horizontal partition diaphragm 11 is connected with an inner wall of the body 10. In the present embodiment, the body 10 takes human form and has a head 12, a trunk 13, a foot portion 14 and two arms 15. The trunk 13 is connected with the head 12 and is located underneath the head 12. The foot portion 14 is connected with the trunk 13, is located under the trunk 13 and has an air orifice formed through a bottom of the foot portion 14. The two arms 15 are connected with two sides of the trunk 13. The air chambers are respectively defined by the head 12, the trunk 13, the foot portion 14 and the arms 15 and communicate with one another. The partition diaphragm 11 is located at a central portion inside the trunk 13.

Figure 2:
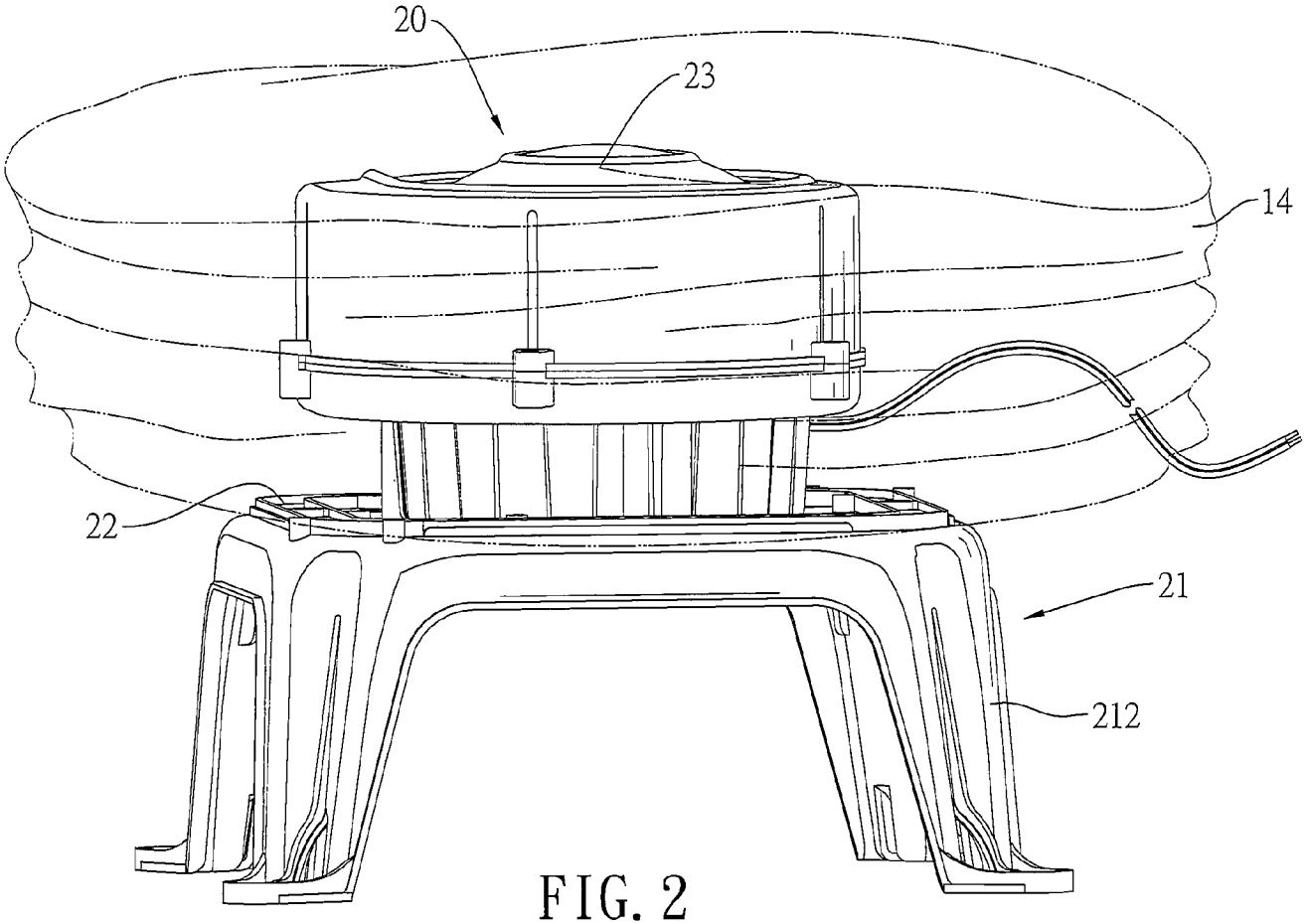
FIG. 2 is an enlarged perspective view of an inflating unit of the shaking inflatable figure in FIG. 1.
Figure 3:
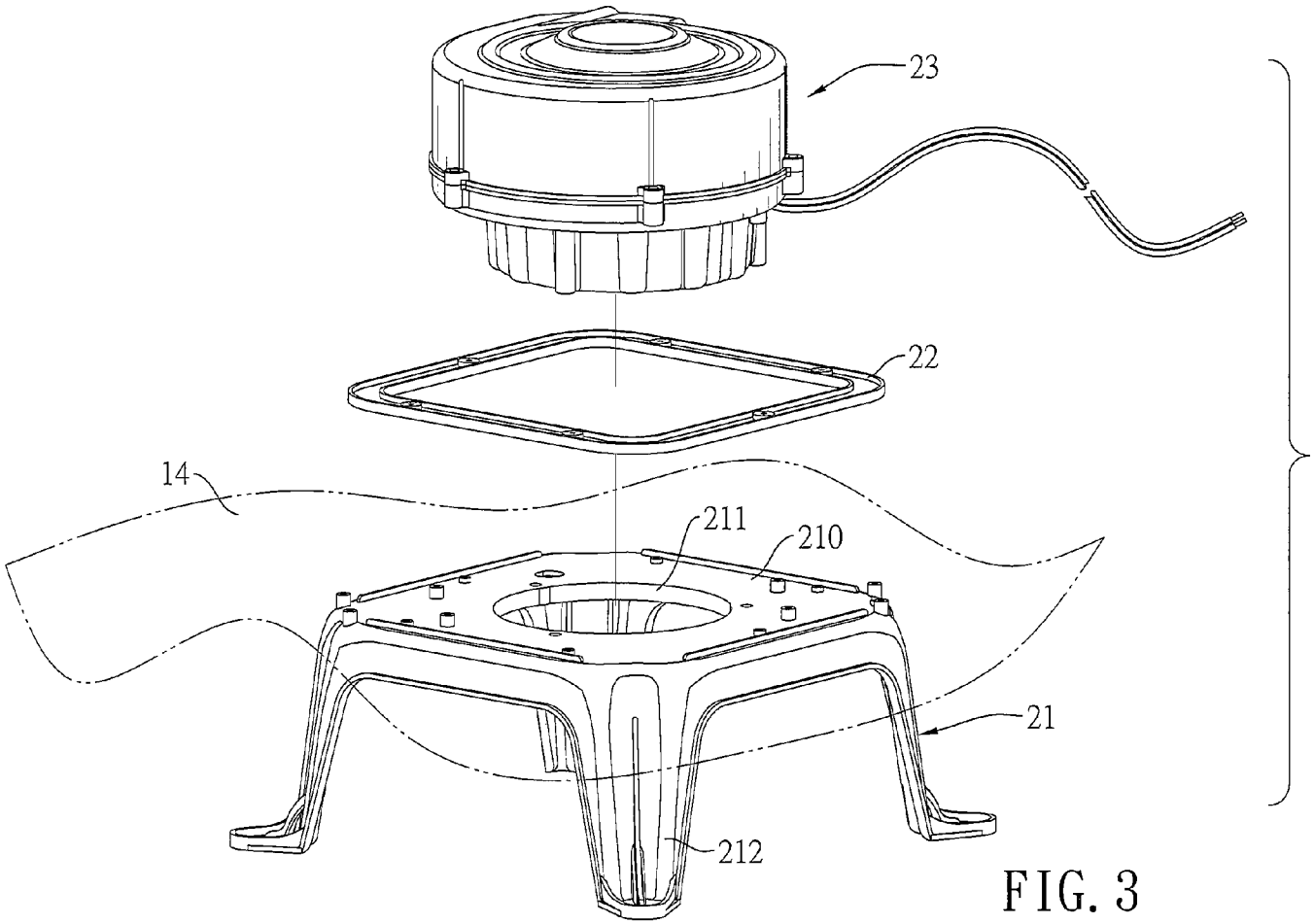
FIG. 3 is a partially exploded perspective view of the inflating unit in FIG. 2.

With reference to FIGS. 1 to 3, the inflating unit 20 has a stand 21, a pressing member 22 and an air pump 23. The stand 21 has a support base 210 and four legs 212. The support base 210 takes the form of a rectangular board and has an air vent 211 centrally formed through the support base 210. The four legs 212 are respectively formed on and protrude from four corners of the support base 210 and can be placed on a mounting plane. The stand 21 is mounted under a bottom of the body 10. The support base 210 is located beneath a bottom of the foot portion 14. The air vent 211 of the support base 210 corresponds to the air orifice of the foot portion 14. The pressing member 22 takes the form of a rectangular frame, is located inside the foot portion 14, and is mounted on a top of the support base 210. A bottom of the foot portion 14 is held between the pressing member 22 and the support base 210 so that the stand 21 can be positioned beneath the foot portion 14. The air pump 23 pertains to a conventional skill, and has an air inlet formed through a bottom portion and an air outlet formed through a top portion. The air pump 23 serves to pump the air near the air inlet to be exhausted through the air outlet, and is mounted inside the body 10. A bottom of the air pump 23 is mounted on the support base 210 of the stand 21. The air inlet of the air pump 23 communicates with the air orifice of the foot portion 14.

Figure 4:
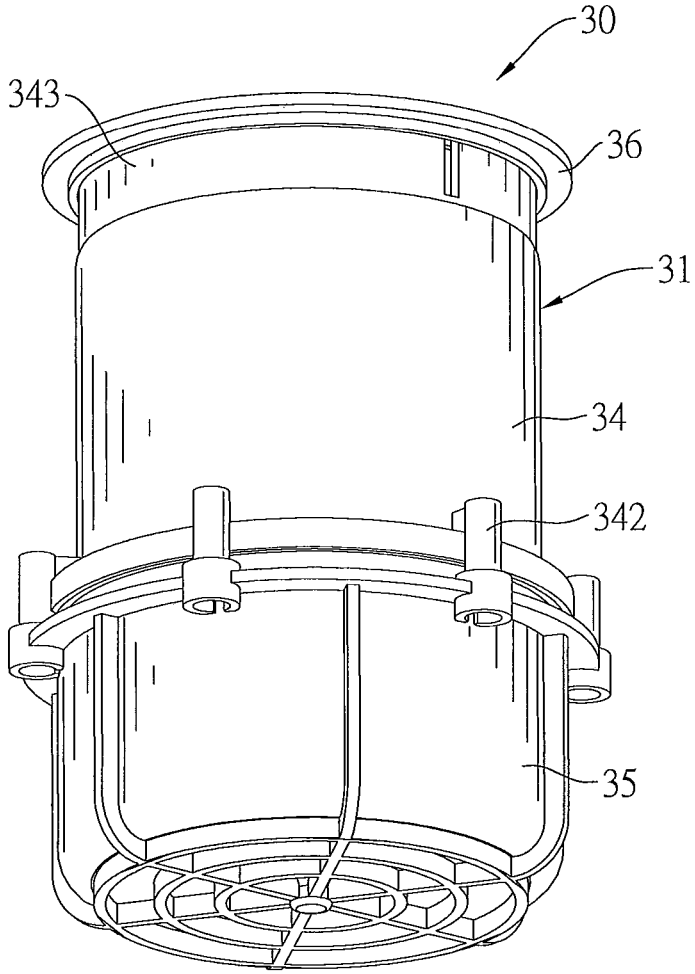
FIG. 4 is an enlarged perspective view of a vibrating unit of the shaking inflatable figure in FIG. 1.
Figure 5:
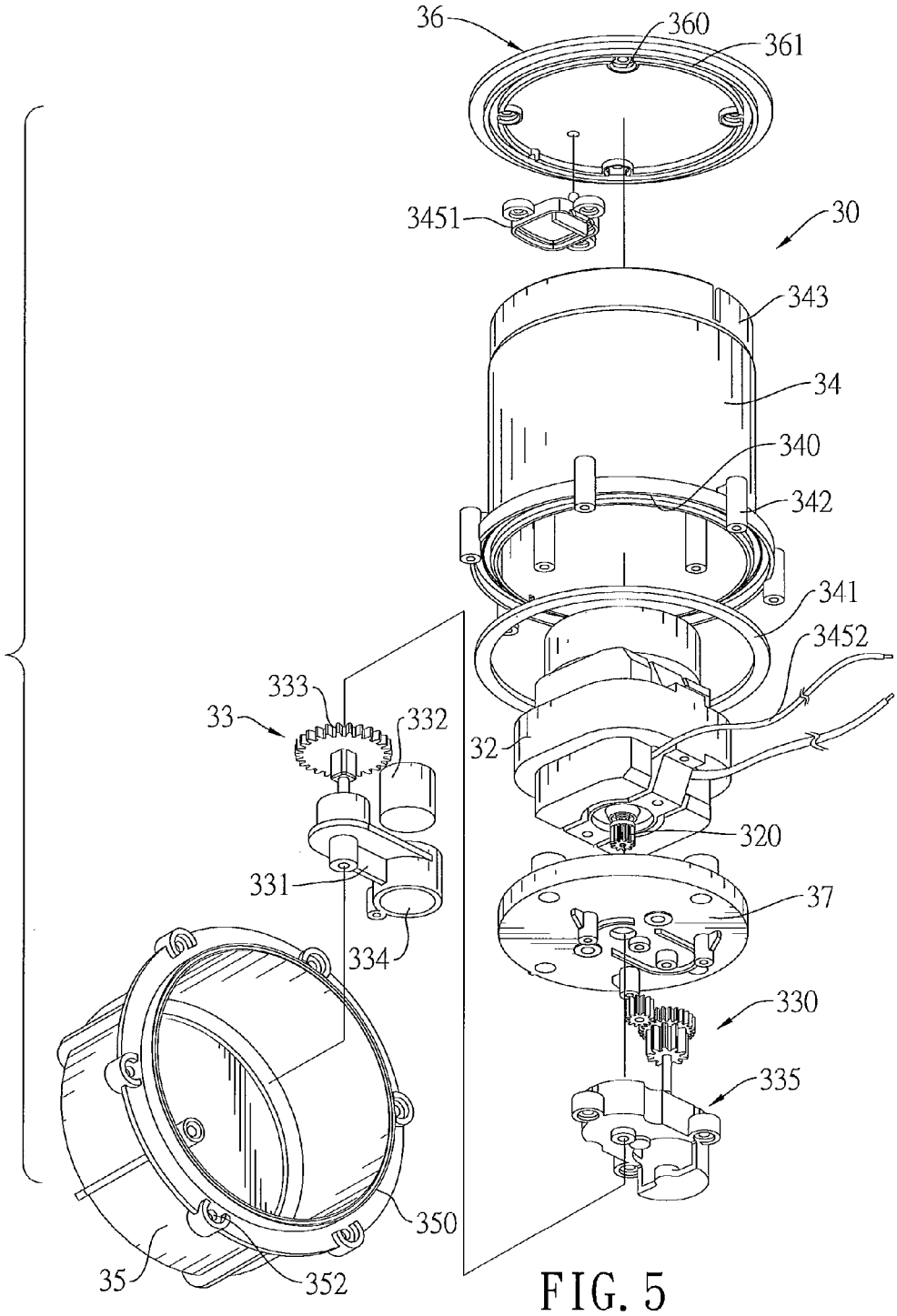
FIG. 5 is an exploded perspective view of the vibrating unit in FIG. 4.

With reference to FIGS. 1, 4 and 5, the vibrating unit 30 has a housing 31, a driving motor 32 and an eccentric vibrator 33.

Figure 6:
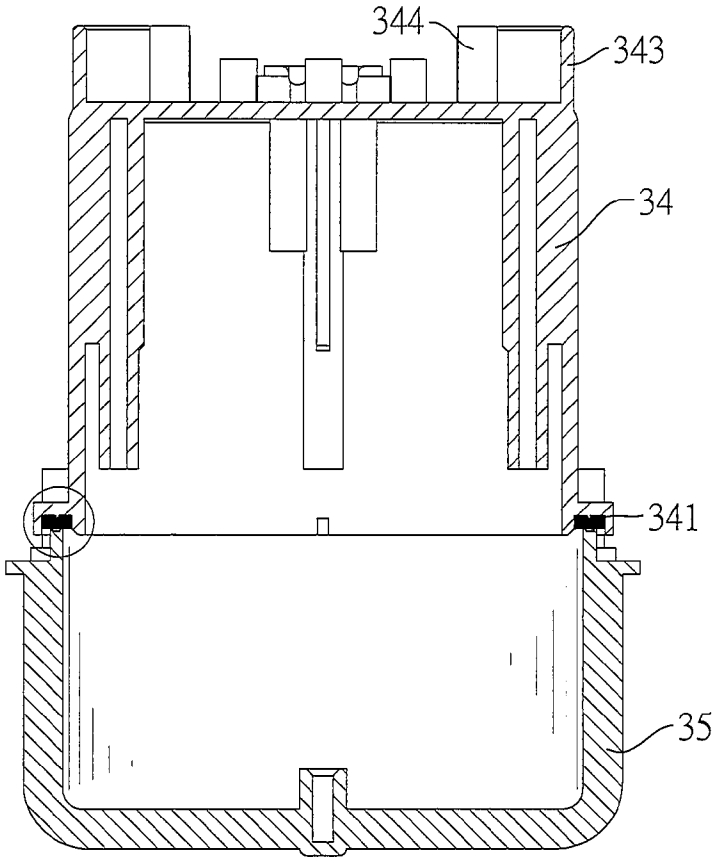
FIG. 6 is a cross-sectional side view of a housing of the vibrating unit in FIG. 4.

With reference to FIGS. 5 and 6, the housing 31 has an upper case 34, a lower case 35 and a fixing plate 37.

The upper case 34 takes the form of a hollow cylinder with an open bottom, and has an annular groove 340, a seal ring 341 and multiple lower pillars 342. The open bottom has an annular edge. The annular groove 340 is formed in the annular edge of the open bottom. The seal ring 341 is waterproof and is mounted in the annular groove 340. The lower pillars 342 are formed around a periphery of the upper case 34, and are adjacent to the open bottom and are spaced apart from one another. Each lower pillar 342 has an assembly hole formed through the lower pillar 342.

Figure 7:
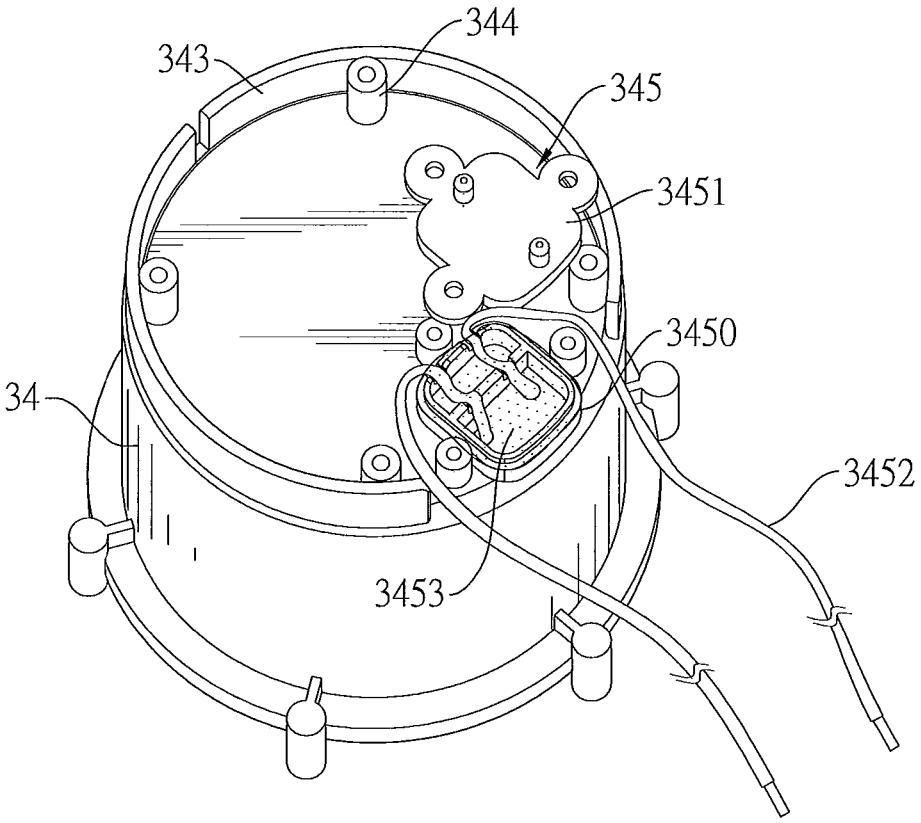
FIG. 7 is a perspective view of a wiring box of the vibrating unit in FIG. 5.

With reference to FIG. 7, the upper case 34 further has an upper engagement wall 343, multiple upper pillars 344 and a wiring box 345. The upper engagement wall 343 is formed on and protrudes from a top of the upper case 34 and has a gap formed through the upper engagement wall 343. The upper pillars 344 are formed on the top of the upper case 34 and are spaced apart from one another. Each upper pillar 344 has an assembly hole formed in a top of the upper pillar 344. The wiring box 345 has a wire holder 3450 and a lid 3451. The wire holder 3450 is mounted on the top of the upper case 34 for two power wires 3452 to extend into the wire holder 3450, and is filled with waterproof adhesive 3453 inside the wire holder 3450. The lid 3451 is combined with the wire holder 3450 to close the wiring box 345.

With reference to FIGS. 4 and 5, the upper case 34 further has a top cover 36 detachably mounted on the engagement wall 343 of the upper case 34. The top cover 36 is disc-shaped, and has multiple assembly slots 360 and an engagement groove 361. The assembly slots 360 are formed in a bottom of the top cover 36, and are spaced apart from one another. Each assembly slot 360 has a through hole. The engagement groove 361 is an annular channel formed in the bottom of the top cover 36. The upper engagement wall 343 of the upper case 34 is located under the partition diaphragm 11 of the body while the top cover 36 is located above the partition diaphragm 11. The engagement groove 361 engages the upper engagement wall 343, and the upper pillars 344 are respectively sleeved in the assembly slots 360. Multiple fasteners are used to respectively penetrate through the assembly slots 360 and the assembly holes of the upper pillars 344 to fasten the top cover 36 on the upper case 34 so that the partition diaphragm 11 is held between the top cover 36 and the upper engagement wall 343 and the upper case 34 is fastened on the partition diaphragm 11.

Figure 6A:
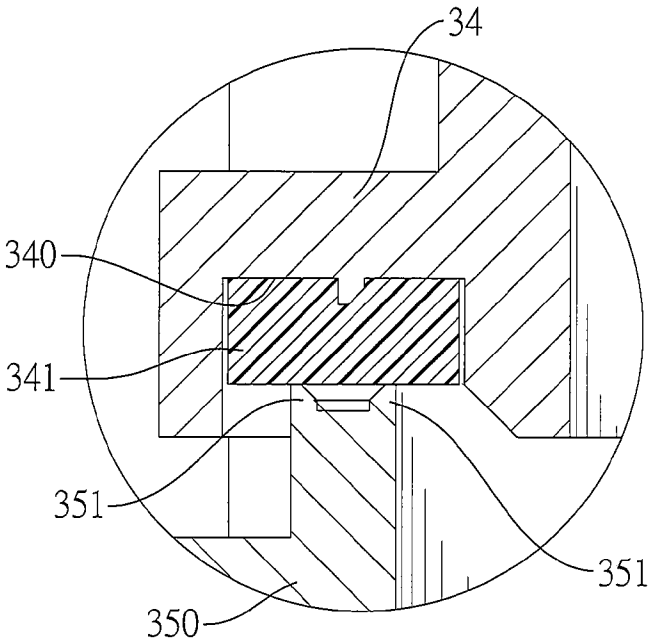
FIG. 6A is an enlarged cross-sectional side view of the housing of the vibrating unit in FIG. 6.

With further reference to FIGS. 5, 6 and 6A, the lower case 35 takes the form of a hollow cylinder with an open top and has a lower engagement wall 350 and multiple assembly slots 352. The lower engagement wall 350 is formed on a circumferential edge on the open top and has two rising edges 351 formed on the lower engagement wall and spaced apart from each other. The assembly slots 352 are formed on the circumferential edge on the open top and spaced apart from one another. Each assembly slot 352 has a through hole. When the open top of the lower case 35 is combined with the open bottom of the upper case 34, the lower engagement wall 350 engages the annular groove 340 of the upper case 34, the upper pillars 342 of the upper case 34 are respectively sleeved in the assembly slots 352 of the lower case 35, and multiple fasteners are used to respectively penetrate through the through holes of the assembly slots 352 of the lower case 35 and the assembly holes of the upper pillars 342 to fasten the upper pillars 342 in the assembly slots 352 so that the upper case 34 and the lower case 35 are combined to form the housing 31. The two rising edges 351 abut against one side of the seal ring 341. A chamber is defined within the housing 31. The fixing plate 37 takes the form of a round board, has multiple mounting holes, and is mounted between the upper case 34 and the lower case 35.

The driving motor 32 is mounted inside the upper case 34, and has a spindle, a driving gear 320 and two power wires 3452. The driving gear 320 is mounted around the spindle and is mounted through one of the mounting holes of the fixing plate 37. The two power wires 3452 extend into the wiring box 345.

The eccentric vibrator 33 has a transmission gear set 330, a rocker arm 331 and a weight 332.

Figure 8:
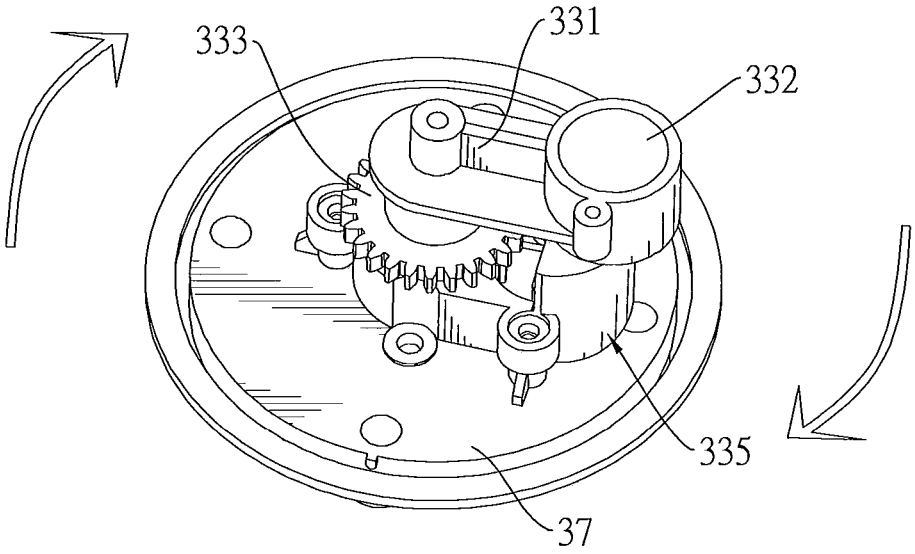
FIG. 8 is an operational perspective view of an eccentric vibrator of the vibrating unit in FIG. 5.

With reference to FIGS. 5 and 8, the transmission gear set 330 has multiple gears engaging each other and mounted inside a gearbox 335. The gearbox 335 is mounted on the fixing plate 37. One gear of the transmission gear set 330 engages the driving gear 320 of the driving motor 32.

A passive gear 333 is mounted on one end of the rocker arm 331 and a weight chamber 334 is formed on the other end of the rocker arm 331. The rocker arm 331 is pivotally mounted on the fixing plate 37. The passive gear 333 engages another gear of the transmission gear set 330.

The weight 332 is a metal block and is mounted inside the weight chamber 334 on the rocker arm 331.

The lighting unit 40 has multiple lighting elements 41 electrically connected with one another. The lighting elements 41 may be conventional light bulbs or an LED lighting module. The lighting unit 40 is mounted inside the body 10. The body 10 is made of a transparent material or a translucent material.

Figure 9:
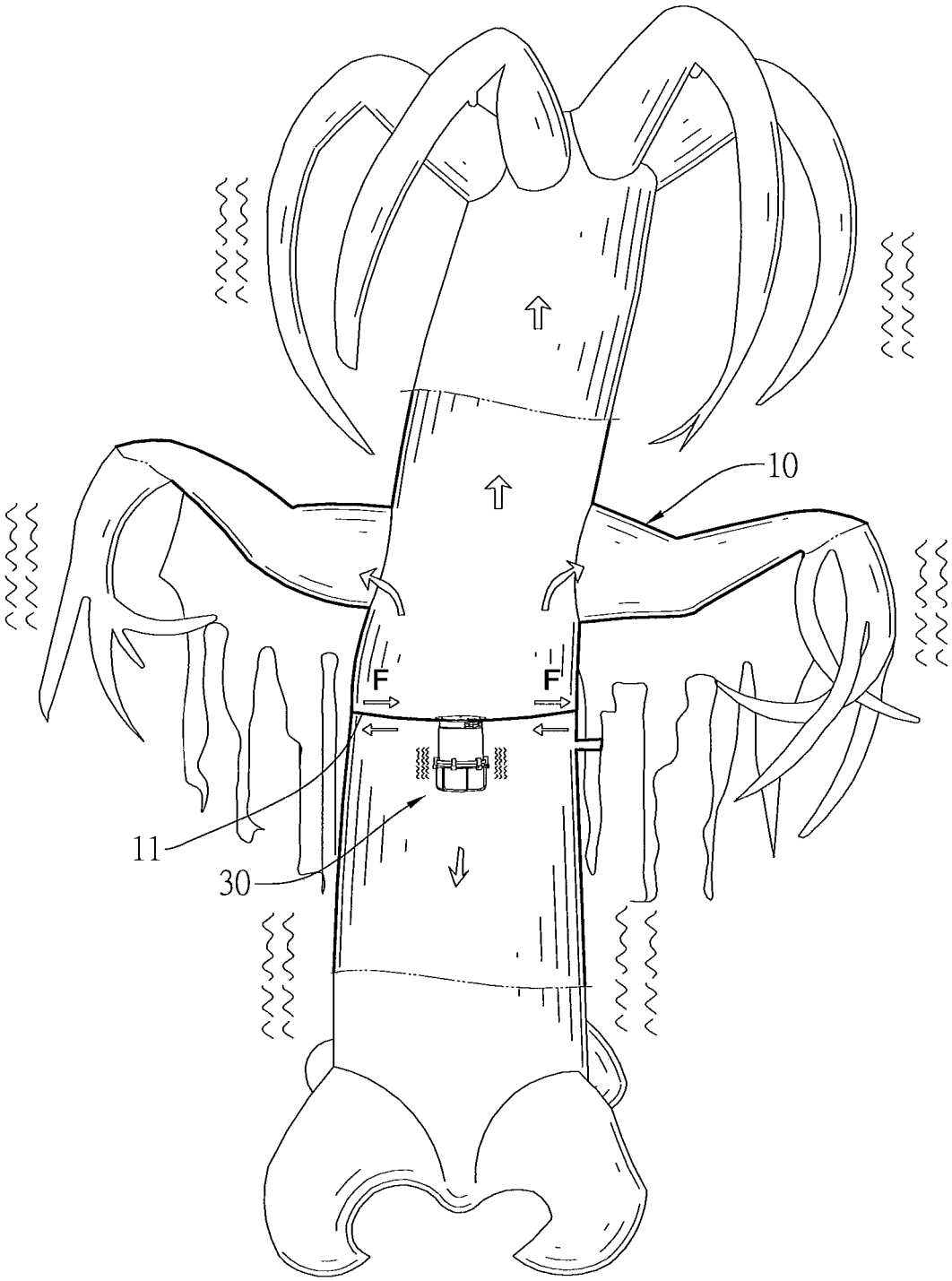
FIG. 9 is an operational perspective view of the shaking inflatable figure in FIG. 1.

When the shaking inflatable figure of the present invention is operated, the air pump 23 of the inflating unit 20 pumps air in the ambient environment to enter the air chambers inside the body 10 of the figure through the air orifice on the bottom of the figure and the figure is inflated and expanded. With further reference to FIGS. 5 and 8, the driving motor 32 rotates its spindle and the driving gear 320, and further drives the transmission gear set 330 through the driving gear 320. The transmission gear set 330 further drives the passive gear 333 to rotate. The rotation of the passive gear 333 further rotates the rocker arm 331. As the weight 332 is also rotated, the center of gravity of the vibrating unit 30 is constantly moved according to the movement of the weight 332 and vibrations with a specific frequency are generated. With reference to FIG. 9, such vibrations are transmitted to the body 10 of the figure through the partition diaphragm 11 so that the body 10 of the figure exhibits a constantly shaking effect for viewers to have more animated visual effect and entertaining pleasure. The lighting elements 41 of the lighting unit 40 can emit light to pass through the transparent body 10 of the figure so that the body 10 of the figure is illuminated to present more animated visual effect.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A shaking inflatable figure comprising:

a body defining an air chamber in the body and having a partition diaphragm, wherein an edge of the partition diaphragm is connected with an inner wall of the body;

an inflating unit mounted inside the body and communicating with the air chamber; and a vibrating unit mounted inside the body, the vibrating unit being mounted on the partition diaphragm and comprising:

a housing mounted on the partition diaphragm;

a driving motor mounted inside the housing; and an eccentric vibrator mounted inside the housing and connected with the driving motor.

2. The shaking inflatable figure as claimed in claim 1, wherein the housing of the vibrating unit has an upper case and a lower case combined with each other and further has a waterproof seal ring mounted between the upper case and the lower case.

3. The shaking inflatable figure as claimed in claim 2, wherein the upper case has an annular groove formed in the upper case for the waterproof seal ring to be mounted in the annular groove; and the lower case has a lower engagement wall formed on the lower case and engaging the annular groove of the upper case, wherein the lower engagement wall has two rising edges formed on the lower engagement wall, spaced apart from each other, and abutting against the waterproof seal ring.

4. The shaking inflatable figure as claimed in claim 3, wherein the upper case further has:

an upper engagement wall formed on and protruding from a top of the upper case and having a gap formed through the upper engagement wall;

multiple upper pillars formed on the top of the upper case and spaced apart from one another, each upper pillar having an assembly hole formed in a top of the upper pillar; and a top cover detachably mounted on the upper engagement wall of the upper case, being disc-shaped, and having:

multiple assembly slots formed in a bottom of the top cover, and spaced apart from one another, each assembly slot having a through hole; and an engagement groove formed on the bottom of the top cover, wherein the upper engagement wall of the upper case is located under the partition diaphragm of the body, the top cover is located above the partition diaphragm, the engagement groove engages the upper engagement wall, and the upper pillars are respectively sleeved in the assembly slots, and multiple fasteners respectively penetrate through the assembly slots and the assembly holes of the upper pillars to fasten the top cover on the upper case.

5. The shaking inflatable figure as claimed in claim 4, wherein the upper case further has a wiring box, and the wiring box has:

a wire holder filled with waterproof adhesive; and a lid combined with the wire holder.

6. The shaking inflatable figure as claimed in claim 2, wherein the driving motor is mounted inside the upper case, and has:

a spindle; and a driving gear mounted around the spindle;

the eccentric vibrator has:

a transmission gear set having multiple gears engaging each other and mounted inside a gearbox, wherein the gearbox is mounted on a fixing plate mounted inside the housing, and one gear of the transmission gear set engages the driving gear of the driving motor;

a rocker arm pivotally mounted on the fixing plate and having a passive gear mounted on one end of the rocker arm and engaging another gear of the transmission gear set; and a weight formed on the other end of the rocker arm.

7. The shaking inflatable figure as claimed in claim 2, wherein the driving motor is mounted inside the upper case, and has:

a spindle; and a driving gear mounted around the spindle;

the eccentric vibrator has:

a transmission gear set having multiple gears engaging each other and mounted inside a gearbox, wherein the gearbox is mounted on a fixing plate mounted inside the housing, and one gear of the transmission gear set engages the driving gear of the driving motor;

a rocker arm pivotally mounted on the fixing plate and having a passive gear mounted on one end of the rocker arm and engaging another gear of the transmission gear set; and a weight formed on the other end of the rocker arm.

8. The shaking inflatable figure as claimed in claim 3, wherein the driving motor is mounted inside the upper case, and has:

a spindle; and a driving gear mounted around the spindle;

the eccentric vibrator has:

a transmission gear set having multiple gears engaging each other and mounted inside a gearbox, wherein the gearbox is mounted on a fixing plate mounted inside the housing, and one gear of the transmission gear set engages the driving gear of the driving motor;

a rocker arm pivotally mounted on the fixing plate and having a passive gear mounted on one end of the rocker arm and engaging another gear of the transmission gear set; and a weight formed on the other end of the rocker arm.

9. The shaking inflatable figure as claimed in claim 4, wherein the driving motor is mounted inside the upper case, and has:

a spindle; and a driving gear mounted around the spindle;

the eccentric vibrator has:

a transmission gear set having multiple gears engaging each other and mounted inside a gearbox, wherein the gearbox is mounted on a fixing plate mounted inside the housing, and one gear of the transmission gear set engages the driving gear of the driving motor;

a rocker arm pivotally mounted on the fixing plate and having a passive gear mounted on one end of the rocker arm and engaging another gear of the transmission gear set; and a weight formed on the other end of the rocker arm.

10. The shaking inflatable figure as claimed in claim 5, wherein the driving motor is mounted inside the upper case, and has:

a spindle; and a driving gear mounted around the spindle;

the eccentric vibrator has:

a transmission gear set having multiple gears engaging each other and mounted inside a gearbox, wherein the gearbox is mounted on a fixing plate mounted inside the housing, and one gear of the transmission gear set engages the driving gear of the driving motor;

a rocker arm pivotally mounted on the fixing plate and having a passive gear mounted on one end of the rocker arm and engaging another gear of the transmission gear set; and a weight formed on the other end of the rocker arm.

11. The shaking inflatable figure as claimed in claim 6, further comprising a lighting unit, wherein the body is made of a soft, thin and transparent material.

12. The shaking inflatable figure as claimed in claim 7, further comprising a lighting unit, wherein the body is made of a soft, thin and transparent material.

13. The shaking inflatable figure as claimed in claim 8, further comprising a lighting unit, wherein the body is made of a soft, thin and transparent material.

14. The shaking inflatable figure as claimed in claim 9, further comprising a lighting unit, wherein the body is made of a soft, thin and transparent material.

15. The shaking inflatable figure as claimed in claim 10, further comprising a lighting unit, wherein the body is made of a soft, thin and transparent material.

* * * * *